US006036335A

United States Patent [19]

Openiano

[11] Patent Number: 6,036,335

[45] Date of Patent: Mar. 14, 2000

[54] CUT-TO-LENGTH LINEAR LIGHTING, AND TWO-DIMENSIONAL AND THREE-DIMENSIONAL DECORATIVE LIGHTS, FROM OMNI-DIRECTIONAL LED LAMPS

[76] Inventor: Renato M. Openiano, 934 Fuchsia La., San Diego, Calif. 92154

[21] Appl. No.: 08/939,280

[22] Filed: Sep. 29, 1997

[51] Int. Cl.[7] ..... F21V 7/02

[52] U.S. Cl. ..... 362/241; 362/249; 362/252; 362/298; 362/305; 362/800; 362/807

[58] Field of Search ..... 362/217, 240, 362/241, 247, 249, 252, 298, 504, 305, 405, 800, 807

[56] References Cited

U.S. PATENT DOCUMENTS

| | | | |
|---|---|---|---|
| 1,676,463 | 7/1928 | Ryan | 362/305 |
| 3,272,976 | 9/1966 | Charchan et al. | 362/807 |
| 4,453,201 | 6/1984 | Prouty | 362/252 |
| 5,130,909 | 7/1992 | Gross | 362/241 |
| 5,594,433 | 1/1997 | Terlep | 362/800 |
| 5,642,933 | 7/1997 | Hitora | 362/252 |

FOREIGN PATENT DOCUMENTS

| | | | |
|---|---|---|---|
| 26195 | 4/1923 | France | 362/305 |
| 310386 | 1/1919 | Germany | 362/247 |

*Primary Examiner*—Alan Cariaso
*Attorney, Agent, or Firm*—Fuess & Davidenas

[57] ABSTRACT

A housing holds embedded in arrayed order along an axis (i) a conical first omni-directional reflector, (ii) a directional second reflector and a second LED, (iii) a directional first reflector and a first LED, and (iv) a conical second omni-directional reflector. Light from the first (second) LED as is in part reflected by the directional first (second) reflector is omni-directionally dispersed by the first (second) omni-directional reflector. All reflectors optionally serve as electrical connections to the LED's. A linear light constructed as a chain of these omni-directional LED lamps wired in electrical parallel may be easily cut to length. Other two and three-dimensional omni-directionally-illuminating lighting fixtures are possible, such as in the shape of crosses and stars and the six-pointed metal object used in the game of jacks.

10 Claims, 2 Drawing Sheets

CUT-TO-LENGTH LINEAR LIGHTING, AND TWO-DIMENSIONAL AND THREE-DIMENSIONAL DECORATIVE LIGHTS, FROM OMNI-DIRECTIONAL LED LAMPS

BACKGROUND OF THE INVENTION

1. Field of the Invention

The present invention generally concerns Light Emitting Diode, or LED, lamps—particularly such as may be omni-directional—and larger illumination fixtures made from typically numerous ensembles of such omni-directional LED lamps.

The present invention particularly concerns cut-to-length linear lights, and two- and three-dimensional decorative lights, made from one, two and three dimensional arrays, typically very numerous arrays, of omni-directional LED lamps.

2. Description of the Prior Art

In one of its aspects, the present invention will be seen to concern LED lamps that are omni-directional.

LED's have long been combined with diffusing elements to emit light omni-directionally. For example U.S. Pat. No. 5,140,220 to Yasuo Hasegawa for a LIGHT DIFFUSION TYPE LIGHT EMITTING DIODE concerns an improved light emitting diode housing member in the form of a transparent housing that extends over the light emitting surface of the LED, and that positions a plurality of granular optical particles, such as calcium fluoride, over the LED source of light to provide a diffusion of the emitted light, thereby increasing its viewing angle.

Another, larger and separate, diffuser for an LED lamp is shown in U.S. Pat. No. 5,325,271 to James T. Hutchisson for a MARKER LAMP WITH LED ARRAY AND PRISMATIC DIFFUSER. This patent concerns a lamp assembly for use as a vehicle marker lamp or a vehicle clearance lamp. The lamp assembly includes a multifaceted prismatic diffuser to which a number of LEDs are fitted. The diffuser has an outwardly directed portion, a center portion, and an inwardly directed portion. The outwardly directed portion and inwardly directed portion are both formed with angularly offset facets. The LEDs are fitted into openings that are formed in the facets of the inwardly directed portion of the diffuser. When the LEDs are energized, the light emitted thereby is initially diffused throughout all of the diffuser. It is then emitted from the facets forming the outer portion of the diffuser such that it can be seen over a wide viewing angle.

Diffusers generally suffer from absorbing some of the light, thus resulting in a reduction in emitted light intensity.

An arrangement of LED's and other elements in an omni-directional lamp in a manner that is perhaps closest to the present invention is shown in U.S. Pat. No. 5,594,433 to Stephen K. Terlep for OMNI-DIRECTIONAL LED LAMPS. The Terlep patent concerns three embodiments of omni-directional LED lamps. In a first embodiment, two LEDs are mounted side by side in a miniature bayonet base that can fit into a conventional miniature bayonet socket. The side-by-side LEDs face semi-spherical mirror reflectors that distribute the unidirectional light emitted from the LEDs over an omni-direction. A second embodiment is most similar to the preferred embodiment of the present invention. In this embodiment two LEDs face one another with a spherical mirror reflector between to cause unidirectional light to be omni-directional. In a third embodiment, a semi-spherical reflector is mounted in the top of a lens cover above an LED. The components are housed in a sealable casing for marine applications where the casing can be mounted to a dock piling.

The second embodiment of the Terlep omni-directional LED lamps where two opposite-facing LED's are located on opposite sides of a single spherical reflector (with two hemispherical reflecting surfaces) may be contrasted with a preferred embodiment of the present invention. In the preferred embodiment of the present invention it will be seen that (A1) a first LED/reflector pair in accompaniment with (A2) an opposed first conical—not spherical but conical—reflector is interleaved with (B1) an opposite-facing second LED/reflector pair in accompaniment with (B2) an opposed second conical reflector, ergo (A2)-(B1)-(A1)-(B2). The differently shaped reflectors—conical versus spherical—and the different organization of components in the present invention are directed towards providing an undiminished-intensity LED light source that is truly extended—as opposed to being merely distended as the Terlep source will visually appear to be.

In fact, the substantially uniform, substantially distended, substantially circumferentially omni-directional LED light sources of the present invention will be seen to be most suitable to make light fixtures of uncommon, if not totally unique, shapes and forms. For example, if the extended LED light sources are arrayed in a chain, i.e., (A2)-(B1)-(A1)-(B2)-(A2)-(B1)-(A1)-(B2)-(A2)-(B1)-(A1)-(B2), etc., then a "linear light" of remarkably homogeneous light output is created. This "linear light" may even be "cut to length".

Still other, three-dimensional, forms are possible. Conceptually, in terms of the light illumination realized by two- and three-dimensionally arrayed omni-directional LED light sources of the present invention, the illumination provided is somewhat as might be imagined if the illumination derived from panelescent, or sheet, lighting was expanded into cylindrical and other solid forms. Quite simply, the one, two-, and three-dimensionally arrayed omni-directional LED light sources of the present invention emit light, or "glow", all over (in one, two-, or three-dimensions, as their shape and form dictate).

The arrayed LEDs of the present invention are electrically interconnected in the manner of discrete electrical components. It is known to so electrically interconnect to LEDs in the prior art. For example, U.S. Pat. No. 4,590,667 to Ralph E. Simon for a METHOD AND APPARATUS FOR ASSEMBLING SEMICONDUCTOR DEVICES SUCH AS LEDS OR OPTODETECTORS shows how a wafer divided into rows of abutted end-to-end dice (i.e., semiconductor chips) may first be placed on a thin, non-elastic membrane and drawn tightly over a knife-edge to successively separate each row of dice from the membrane. The dice are then attached to individual lead frames directly or are picked up by a vacuum fixture and carried to a position where they are secured to the lead frames and are wire bonded. After bonding, the components are assembled into finished sub-assemblies. In one embodiment, LED lamps are fabricated. A reflector is secured to each lead frame over the die positioned thereon, and the lead frame, die and reflector are molded into a lamp subassembly, which is then used to form a larger lamp or display fixture. The fixtures of the present invention are analogous in construction, but different in form.

SUMMARY OF THE INVENTION

The present invention contemplates (i) a particular preferred type of omni-directional LED lamps, and (ii) certain lights, including cut-to-length substantially one-dimensional linear lights and two- and three-dimensional decorative lights, made from arrays—occasionally very numerous arrays—of such omni-directional LED lamps.

1. An Omni-directional LED Lamp

In one of its aspects, the present invention is embodied in an omni-directional LED lamp, nominally of a cylindrical form, that reflects light in a 360° circumferential direction without rotation. (By 360° circumferential direction it is meant that light is emitted all the way around the circumference of the cylinder; the actual light emissions being substantially radial.)

The preferred lamp includes a first LED backed by a first directional reflector transmitting light substantially directionally as a first light beam in a first direction, and a second LED backed by a second directional reflector, both located within the first light beam, transmitting light substantially directionally as a second light beam in a second direction. Each of the LEDs and its associated directional reflector are thus within the light beam of the other, although this is incidental and not crucial to the organization of components within the lamp.

Continuing, a first omni-directional reflector, having a continuous conical reflective surface with an apex pointed towards the first LED that is substantially upon its conical axis, intersects upon its exterior surface the first light beam and reflects this first light beam substantially in a 360° circumference. Light from the first LED is thus rendered omni-directional radially to the conical axis, although, necessarily, the light only commences to "fan out" from the conical reflective surface when it has progressed so far along the axis so as to first meet this conical surface. In other words, the light from the first diode is omni-directionally dispersed once it reaches the first omni-directional reflector, but not before.

Likewise, a second omni-directional reflector, having a continuous conical reflective surface with an apex pointed towards the second LED that is substantially upon its conical axis, intersects upon its exterior surface the second light beam and reflects this second light beam substantially in a 360° circumference. The second LED is thus also rendered omni-directional.

A housing serves to hold in arrayed order, and substantially along an axis, each of (i) the first omni-directional reflector, (ii) the directional second reflector and the second LED, (iii) the first LED and the directional first reflector, and (iv) the second omni-directional reflector.

The two omni-directionally reflected light beams that are reflected from the two omni-directional reflectors essentially merge; there is no gap between the beams. This is the reason for the mirror-like duality of the arrayed elements of the lamp: there are no "dark spots" and light is emitted everywhere. When the LEDs are "on", producing light illumination, then the entire "lamp" emits light omni-directionally, and appears as a spatially extended light source to the eye. This extension, realized by principles of optics, is, of course, quite the opposite of the light emission from the LEDs themselves, which emit substantially as point light sources.

Optionally, each of the first directional reflector, the second directional reflector, the first omni-directional reflector, and the second omni-directional reflector may be made electrically conducting. In this case the lamp further includes an electrical first terminal and at least one, and normally two, electrical second terminals. The at least one electrical second terminal is electrically connected to the first omni-directional reflector is electrically connected to the second directional reflector is electrically connected across the second LED to the electrical first terminal. Meanwhile the at least one electrical second terminal is also, further, electrically connected to the second omni-directional reflector is electrically connected to the first directional reflector is electrically connected across the first LED also to the electrical first terminal. Accordingly, the electrical paths to and through the LEDs of the lamp are within the reflectors of the lamp, simplifying both (i) efficient automated product of the entire lamp and (ii) easy electrical connection to the finished lamp.

2. A Linear Light

In another of its aspects, the present invention is embodied in a linear light, meaning a substantially one-dimensional light source of indefinite length.

The preferred linear light includes a multiplicity, potentially a great multiplicity, of substantially cylindrical omni-directional LED lamps each of which reflects light in a 360° circumferential direction. (As is uniformly the case in this specification disclosure, a "360° circumferential direction" means that light is emitted all the way around the circumference of the cylinder; the actual light emissions being substantially radial.) Each LED lamp has (i) a LED backed by a directional reflector to transmit light substantially directionally in a light beam, and (ii) an omni-directional reflector, having a continuous conical reflective surface with an apex pointed towards the LED that is substantially upon its conical axis, that intersects the light beam upon its exterior surface and that reflects this light beam substantially in a 360° circumference, thus rendering the LED omni-directional.

An elongate cylindrical housing, normally a simple transparent hose or tube or the like, holds the multiplicity of substantially cylindrical omni-directional LED lamps in a chain, normally contiguously one to the next.

The substantial appearance of the chained multiplicity of omni-directional LED lamps is thus as an elongate linear light source. The light source appears as a rope, or a cord, of continuous light emission.

The multiplicity of omni-directional LED lamps are preferably electrically connected in parallel. The elongate cylindrical housing may typically be severed by cutting at any arbitrary location. In this manner the linear light can be cut to any arbitrary length, giving "cut-to-length" lighting.

3. Two- and Three-Dimensional Multi-armed Lighting Fixtures

In yet another of its aspects, the present invention is embodied in a two-dimensional array, or in a three-dimensional multi-armed lighting fixture.

Each preferred lighting fixture includes a number of typically cylindrical elongate members each of which reflects light in a 360° circumferential direction. Each member incorporates at least one LED lamp that has (i) a LED backed by a directional reflector to transmit light substantially directionally in a light beam, and (ii) an omni-directional reflector, having a continuous conical reflective surface with an apex pointed towards the LED that is substantially upon its conical axis, that intersects the light beam upon its exterior surface and reflects this light beam substantially in a 360° circumference, thus rendering the LED omni-directional.

A housing holds the plurality of members radially extended in a pattern as 360°-circumferentially-illuminated arms of a lighting fixture.

The housing may, for example, hold the plurality of members radially extended in a two-dimensional, or planar, pattern. If the number of members equals four, then they may typically be held by the housing in the planar pattern of a cross. If the number of members equals five, then they may typically be held by the housing in the planar pattern of a star. Finally, the members may simply be held in a regular grid array, making a thick "sheet" of light.

The housing may alternatively, for example, hold the plurality of members radially extended in a three-dimensional pattern.

If the number of members equals six, then they may typically be held by the housing in the three-dimensional pattern of a six-pointed metal object used in the game of jacks. Other complex three-dimensional patterns of both abstract—e.g., a glowing decahedron—and real form—e.g., a representation of a glowing angel—are possible.

These and other aspects and attributes of the present invention will become increasingly clear upon reference to the following drawings and accompanying specification.

DESCRIPTION OF THE PREFERRED EMBODIMENT

Figure 1:
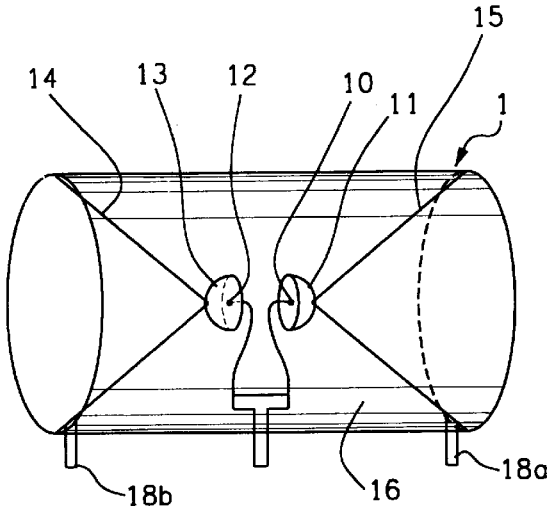
FIG. 1 is a diagrammatic perspective view showing a preferred embodiment of an omni-directional LED lamp, reflecting light in a 360° circumferential direction without rotation, in accordance with the present invention.

A preferred embodiment of an omni-directional LED lamp 1 in accordance with the present invention is shown in FIG. 1. The lamp 1 serves to emit light in a 360° circumferential direction without rotation.

The preferred lamp 1 includes a first LED 10 backed by a first directional reflector 11 transmitting light substantially directionally as a first light beam in a first direction, which first direction is to the left in FIG. 1. A second LED 12 is obscured in FIG. 1 by a second directional reflector 13. Note that both these elements are located within the first light beam, They serve to transmit light substantially directionally as a second light beam in a second direction, which is to the right in FIG. 1. Each of the LEDs 10, 12 and its associated directional reflector 11, 13 are thus within the light beam of the other.

Continuing in FIG. 1, a first omni-directional reflector 14, having a continuous conical reflective surface with an apex pointed towards the first LED 10 that is substantially upon its conical axis, intersects upon its exterior surface the first light beam and reflects this first light beam substantially in a 360° circumference to the substantially cylindrical body of the lamp 1. Light from the first LED 10 is thus rendered omni-directional radially to the conical axis of the first omni-directional reflector 14. Clearly, however, this light will only commence to "fan out" from the conical reflective surface of the first omni-directional reflector 14 when it has traveled so far from the first LED 10 so as to encounter this first omni-directional reflector 14.

Meanwhile, and likewise, a second omni-directional reflector 15 has a continuous conical reflective surface with an apex pointed towards the second LED 12 that is substantially upon its conical axis. This second omni-directional reflector 15 intersects upon its exterior surface the second light beam and reflects this second light beam substantially in a 360° circumference. Light from the second LED is thus also rendered omni-directional.

The two omni-directionally reflected light beams essentially merge; there is no gap. When the LEDs 10, 12 are both "on", producing light illumination, then the entire lamp 1 emits light omni-directionally, and appears as a distended light source to the eye.

A housing 16 is typically made of plastic. It serves to hold each of (i) the first omni-directional reflector 14, (ii) the directional second reflector 13 and the second LED 12, (iii) the first LED 10 and the directional first reflector 11 and , and (iv) the second omni-directional reflector 15, rigidly arrayed in precise order and position.

Figure 2:
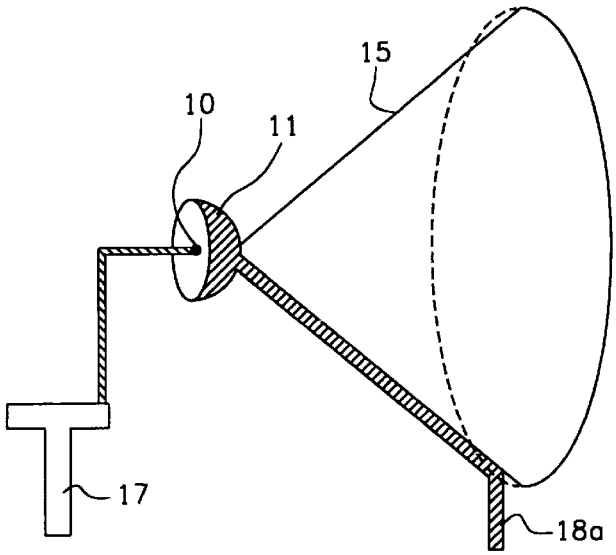
FIG. 2 is a detail cut-away perspective view of the omni-directional LED lamp in accordance with the present invention previously seen in FIG. 1 where a first directional reflector, a second directional reflector, a first omni-directional reflector, and a second omni-directional reflector are electrically conducting metal.

Referring next to the detail view of FIG. 2, each of the first directional reflector 11 (not shown in FIG. 2) and the second directional reflector 13, the first omni-directional reflector 14 and the second omni-directional reflector 15 (not shown in FIG. 2) are made to be electrically conducting. In this case the lamp 1 further includes an electrical first terminal 17 and at least one, and normally two, electrical second terminals 18*a*, 18*b*. The at least one electrical second terminal 18*a, b* is electrically connected to the first omni-directional reflector 14 is electrically connected to the second directional reflector 13 is electrically connected across the second LED 12 to the electrical first terminal 17. Meanwhile the at least one electrical second terminal 18*a, b* is also, further, electrically connected to the second omni-directional reflector 15 is electrically connected to the first directional reflector 11 is electrically connected across the first LED 10 also to the electrical first terminal 17. Accordingly, the electrical paths to and through the LEDs of the lamp are within the reflectors of the lamp, simplifying efficient automated product of the entire lamp.

Figure 3:
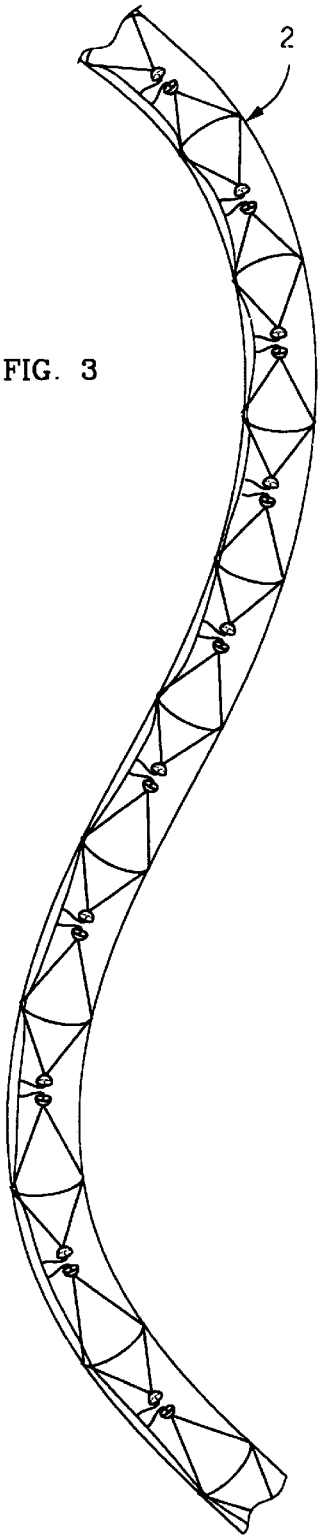
FIG. 3 is a diagrammatic perspective view of a linear light made with the one-dimensionally arrayed omni-directional LED lamps in accordance with the present invention previously seen in FIG. 1.

A one-dimensional, or linear, light fixture 2 constructed from omni-directional LED lamps 1 in accordance with the present invention is shown in FIG. 3. The linear light fixture 2 clearly includes any number of omni-directional LED lamp 1 physically and electrically connected in a chain array. Just as each one of its lamps 1 reflects light in a 360° circumferential direction, the entire linear light fixture 2 reflects light in a 360° circumferential direction. The substantial appearance of the fixture 2 is that of an elongate linear light source.

The multiplicity of omni-directional LED lamps are preferably electrically connected in parallel. By such connections the linear light fixture 2 may typically be severed by cutting at any arbitrary location. It matters not what may be cut or crushed, including any LED and/or any directional reflector and/or any omni-directional reflector. The linear light fixture 2 can essentially be cut to any arbitrary length, giving "cut-to-length" lighting.

Figure 4:
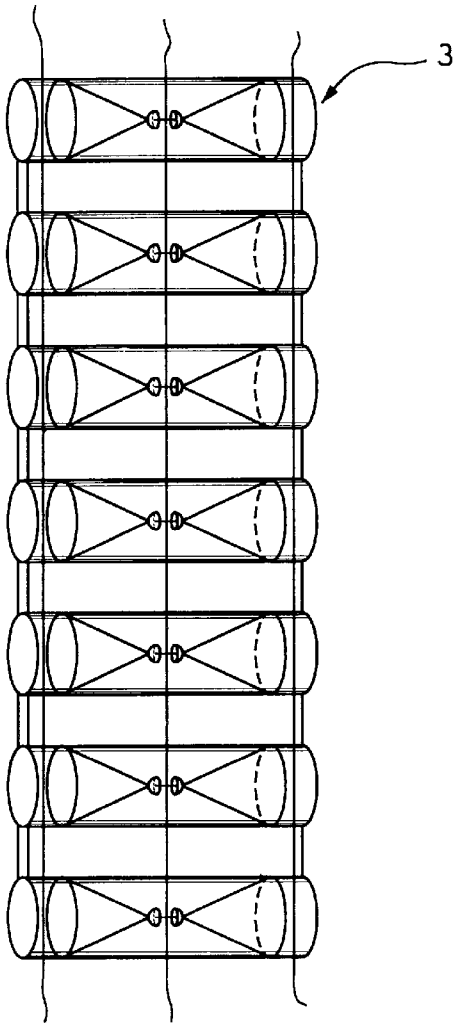
FIG. 4 is a plan view of a two-dimensional light array (of size 1×7) made with the one-dimensionally arrayed omni-directional LED lamps in accordance with the present invention previously seen in FIG. 1.
Figure 5:
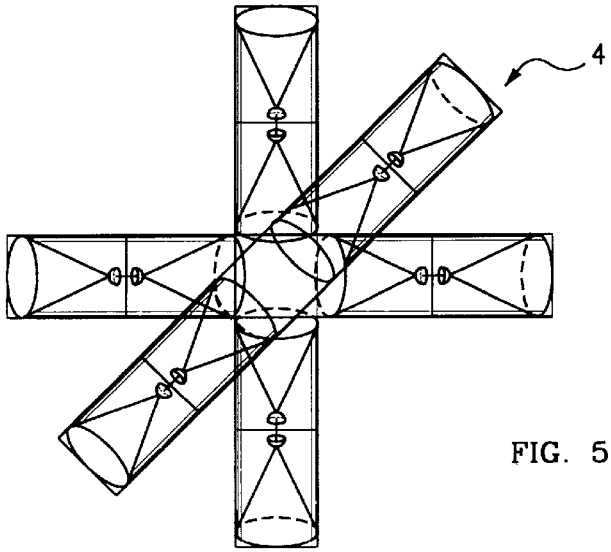
FIG. 5 is a perspective view of a three-dimensional light array made with the one-dimensionally arrayed omni-directional LED lamps in accordance with the present invention previously seen in FIG. 1.

A plan view of a two-dimensional light array 3 (of size 1×7) made with the one-dimensionally arrayed omni-directional LED lamps 1 is shown in FIG. 4, and a three-dimensional light array 4 made with the same one-dimensionally arrayed omni-directional LED lamps 1 is shown in FIG. 5. The two-dimensional light array 3 may clearly be of any arbitrary dimension. It is accordingly "sheet lighting". It is continued to be preferred that the arrayed omni-directional LED lamps 1 be wire connected in electrical parallel.

The three-dimensional lighting fixture 4 of FIG. 5 may be described as "multi-armed". It is not the only form possible, and is merely suggestive of the many possible uses of the omni-directional LED lamps 1 as little (and not so little) "cylinders of light emission". The fixture 4 shown in FIG. 5 is in the form of the three-dimensional six-pointed metal object commonly used in the game of jacks.

All necessary housings for the two- and three-dimensional embodiments are commonly made of molded plastic.

In accordance with the preceding explanation, variations and adaptations of the lamps and lamp fixtures in accordance with the present invention will suggest themselves to a practitioner of the electrical lighting design arts. For example, omni-directional reflectors having other than the preferred conical surfaces could be used, and the aspect ratio and size of the omni-directional lamp 1 may clearly be varied.

In accordance with these and other possible variations and adaptations of the present invention, the scope of the invention should be determined in accordance with the following claims, only, and not solely in accordance with that embodiment within which the invention has been taught.

What is claimed is:

1. An omni-directional LED lamp that reflects light in a 360° circumferential direction without rotation, the lamp comprising:

a first LED backed by a first directional reflector to transmit light substantially directionally in a first light beam in a first direction;

a second LED backed by a second directional reflector, both located within the first light beam, to transmit light substantially directionally in a second light beam in a second direction;

wherein the first LED and first directional reflector are within the second light beam;

a first omni-directional reflector, having a continuous conical reflective surface with an apex pointed towards the first LED that is substantially upon its conical axis, intersecting the first light beam upon its exterior surface and reflecting this first light beam substantially in a 360° circumference thus rendering the first LED omni-directional; and a second omni-directional reflector, having a continuous conical reflective surface with an apex pointed towards the second LED that is substantially upon its conical axis, intersecting the second light beam upon its exterior surface and reflecting this second light beam substantially in a 360° circumference thus rendering the second LED omni-directional; and a housing for holding in arrayed order substantially along an axis the first omni-directional reflector, the directional second reflector and the second LED, the directional first reflector and the first LED, and the second omni-directional reflector.

2. The omni-directional LED lamp according to claim 1 further comprising:

wherein each of the first directional reflector, the second directional reflector, the first omni-directional reflector, and the second omni-directional reflector are electrically conducting; and wherein the lamp further comprises:

an electrical first terminal;

at least one electrical second terminal;

wherein the at least one electrical second terminal is electrically connected to the first omni-directional reflector is electrically connected to the second directional reflector is electrically connected across the second LED to the electrical first terminal; and wherein the at least one electrical second terminal is also, further, electrically connected to the second omni-directional reflector is electrically connected to the first directional reflector is electrically connected across the first LED also to the electrical first terminal;

wherein the electrical paths to and through the LEDs of the lamp are within the reflectors of the lamp.

3. A linear light comprising:

a multiplicity of omni-directional LED lamp modules each of which reflects light in a 360° circumferential direction, each LED lamp module having a first LED backed by an associated first directional reflector to transmit light substantially directionally in a first light beam in a first direction, a second LED backed by an associated second directional reflector, both located within the first light beam, to transmit light substantially directionally in a second light beam in a second direction, wherein the first LED and its associated first directional reflector are within the second light beam, a first omni-directional reflector, having a continuous conical reflective surface with an apex pointed towards the first LED that is substantially upon its conical axis, intersecting the light beam upon its exterior surface and reflecting this light beam substantially in a 360° circumference thus rendering the first LED omni-directional, a second omni-directional reflector, having a continuous conical reflective surface with an apex pointed towards the second LED that is substantially upon its conical axis, intersecting the second light beam upon its exterior surface and reflecting this second light beam substantially in a 360° circumference thus rendering the second LED omni-directional; and an elongate cylindrical housing holding the multiplicity of omni-directional LED lamp modules in a chain;

wherein the substantial appearance of the chained multiplicity of omni-directional LED lamp modules is as an elongate linear light source.

4. The linear light according to claim 3 wherein the elongate cylindrical housing is susceptible of being severed by cutting at any arbitrary location; and wherein the multiplicity of omni-directional LED lamp modules are electrically connected in parallel;

wherein the linear light can be cut to any arbitrary length.

5. A multi-armed lighting fixture comprising:

a plurality of members each of which reflects light in a 360° circumferential direction, each member including a first LED backed by a first directional reflector to transmit light substantially in a first direction in a first light beam, a second LED, located in the first light beam and backed by a second directional reflector to transmit light substantially in a second direction, opposite to the first direction, in a second light beam, a first omni-directional reflector, located in the first light beam and having a continuous conical reflective surface with an apex pointed towards the first LED that is substantially upon its conical axis, intersecting the first light beam upon its exterior surface and reflecting this light beam substantially in a 360° circumference, and a second omni-directional reflector, located in the second light beam and having a continuous conical reflective surface with an apex pointed towards the second LED that is substantially upon its conical axis, intersecting the second light beam upon its exterior surface and reflecting this light beam substantially in a 360° circumference, wherein the first and the second omni-directional reflector thus render light emission from the LEDs omni-directional; and a housing holding the plurality of members radially extended in a pattern as 360°-circumferentially-illuminating arms of a lighting fixture.

6. The multi-armed lighting fixture according to claim 5 wherein the housing is holding the plurality of members radially extended in a planar pattern.

7. The multi-armed lighting fixture according to claim 6 wherein the plurality of members number four, and are held by the housing in the planar pattern of a cross.

8. The multi-armed lighting fixture according to claim 6 wherein the plurality of members number five, and are held by the housing in the planar pattern of a five-pointed star.

9. The multi-armed lighting fixture according to claim 5 wherein the housing is holding the plurality of members radially extended in a three-dimensional pattern.

10. The multi-armed lighting fixture according to claim 9 wherein the plurality of members number six, and are held by the housing in the three-dimensional pattern of a six-pointed metal object used in the game of jacks.

* * * * *